US008453710B2

(12) United States Patent
Asal

(10) Patent No.: US 8,453,710 B2
(45) Date of Patent: Jun. 4, 2013

(54) METHOD FOR REPLACEMENT OF A FILTER PLATE OF A CORE SHOOTER

(75) Inventor: Jurgen Asal, Kleines Wiesental (DE)

(73) Assignee: Luber GmbH, Bazenheid (CH)

( * ) Notice: Subject to any disclaimer, the term of this patent is extended or adjusted under 35 U.S.C. 154(b) by 0 days.

(21) Appl. No.: 13/445,518

(22) Filed: Apr. 12, 2012

(65) Prior Publication Data

US 2012/0279674 A1 Nov. 8, 2012

(30) Foreign Application Priority Data

Apr. 16, 2011 (CH) ..... 680/11

(51) Int. Cl.
*B22C 9/12* (2006.01)
*B22C 15/23* (2006.01)

(52) U.S. Cl.
USPC ..... 164/200; 164/22

(58) Field of Classification Search
USPC ..... 164/19–22, 200–202
See application file for complete search history.

(56) References Cited

U.S. PATENT DOCUMENTS 5,662,155 A * 9/1997 Landua ..... 164/27

* cited by examiner

*Primary Examiner* — Kevin P Kerns
(74) *Attorney, Agent, or Firm* — Ladas & Parry LLP

(57) ABSTRACT

For saving of time and effort during replacement of soiled filter plate locked onto a seal cover of a core shooter, the filter plate is placed on a gas chamber after releasing the lock and by its lateral outward motion from the core shooter is engaged with a receptacle of a tilting plate holder. A subsequent retraction of the gas chamber without the filter plate into the core shooter clears the path for tilting of the plate holder and with it positioning of a second receptacle carrying a cleaned filter plate into the vacant position. A renewed to-and-fro motion of the gas chamber serves the acceptance of the cleaned filter plate and its retraction to the seal cover of the core shooter, in order to lock the plate to the cover.

8 Claims, 2 Drawing Sheets

METHOD FOR REPLACEMENT OF A FILTER PLATE OF A CORE SHOOTER

FIELD OF INVENTION

The invention relates to a method for replacing a filter plate of a core shooter, which forms the lower end of a seal cover, under which, in accordance with the process stages of core shooting, a gas chamber and a core shooting chamber can be alternately inserted by releasing a lock between the seal cover and the filter plate, raising the seal cover from a soiled filter plate, by laterally moving out the gas chamber with overlying filter plate from the core shooter, replacing the soiled filter plate with a cleaned filter plate, retracting the gas chamber with overlying clean filter plate into the core shooter, lowering the seal cover and locking the cleaned filter plate on the seal cover.

In addition, the invention relates to core shooter for the execution of this method, comprising of a vertical, movable seal cover between an opening position and a sealed closing position for the supply of compressed air to a core shooting chamber or for sealing of this replaceable gas chamber by a transverse, motion against it, wherein a detachable filter plate is secured on the seal cover on the outflow side, so that it can be laid detached on the gas chamber and can be moved away laterally with its transverse motion from the seal cover into a replacement position.

BACKGROUND OF INVENTION

For such core shooters working with proportionally high number of cycles for example, of 40 seconds, to maintain sufficient gas permeability, the mentioned filter plate, also referred to as firing sieve must be replaced with a cleaned filter plate for example, respectively after one hour. For this purpose, respective operating personnel must be available at the given time to raise the soiled, proportionally heavy filter plate from the retracted gas chamber and replace it with a cleaned filter plate. Due to the structurally specified height of the machine, this must be carried out in a position unfavorable for operation. Moreover, this is associated with a time consumption of approximately 5 minutes at a time, thus accordingly reducing the effective operating time of the core shooter.

SUMMARY OF INVENTION

The primary object of the invention is to simplify the replacement of a soiled filter plate, so that the incidental time consumption and expenditure of effort reduces and the productivity of the core shooter correspondingly increases. This object is accomplished according to the present invention.

Advantageous embodiments of the invention can be extracted from the following description based on the depicted drawings.

DETAILED DESCRIPTION

Figure 2:
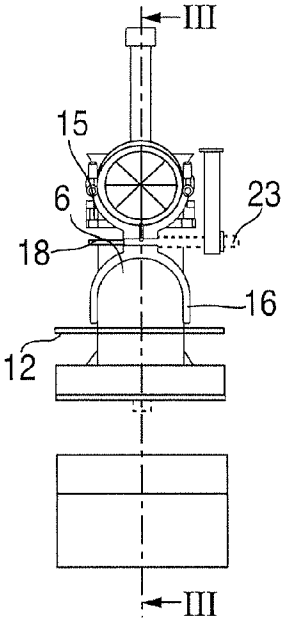
FIG. 2 depicts a side view of the core shooter according to FIG. 1.
Figure 1:
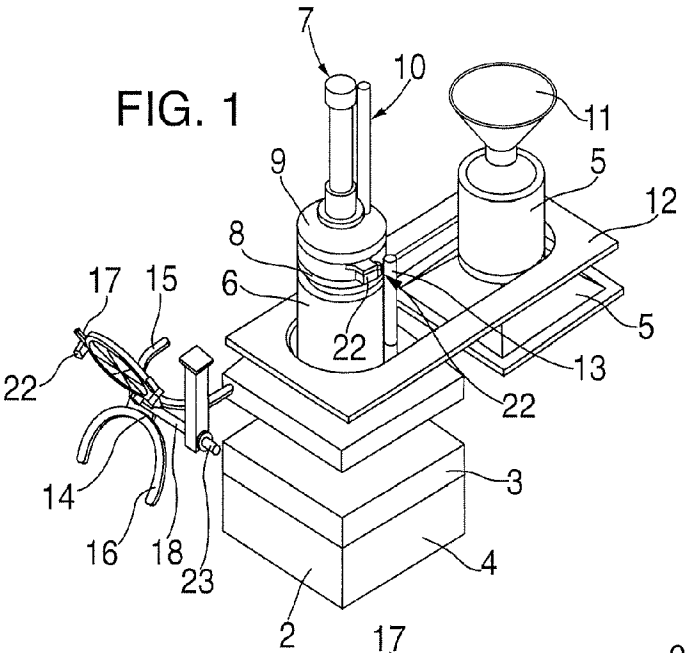
FIG. 1 depicts a perspective and schematic representation of the core shooter according to the invention.
Figure 3:
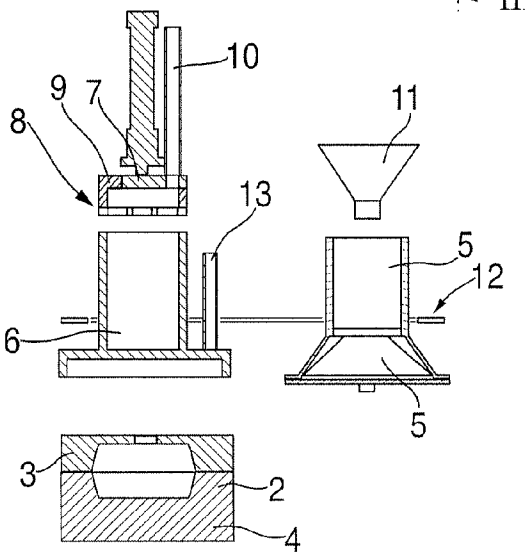
FIG. 3 depicts a longitudinal section through the core shooter according to FIGS. 1 and 2 along the line and FIG. 4 depicts the longitudinal sections of the core shooter according to FIGS. 1 to 3 with successive motion phases of components "a" to "n" of this shooter while replacing a soiled filter plate.
Figure 3:
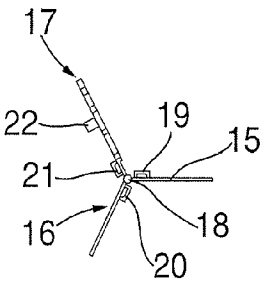

The core shooter 1 comprises primarily of a moulding box 2 with top and bottom moulded parts 3, 4, through which either a core shooting chamber 5 or a gas chamber 6 is brought into position using a transverse movement corresponding to the operating cycle of the shooter. Over this, a seal cover 9, closed below by a filter plate 8, is arranged through a pressing unit 7, sealing it when lowered. A compressed air tube 10 leading into the seal cover 9 is used for loading the core shooting chamber 5 to underlay the core sand in the moulding box 2, which is filled beforehand with a sufficient quantity of moulding sand through the feed hopper 11. For curing of the moulding sand, the core shooting chamber 5 is retracted along a transfer carriage 12 in its position depicted in FIG. 1 and FIG. 3, so that the gas chamber 6 between the seal cover 9 and the moulding box 2 is drawn in and after sealing the attachment of the seal cover 9, gas can flow through the gas pipe 13 provided on it, to the moulding box.

For saving of time and effort during replacement of the filter plate 8 after reaching a specific degree of contamination, a tilting plate holder 14 is provided on the side of the core shooter 1, with three fork-shaped plate receptacles 15, 16 and 17 each arranged preferably at an angle of 120° to one another. Here, a first plate receptacle 15 is arranged at the beginning of the replacement of a soiled filter plate 8 at a level parallel to the transfer carriage 12, so that the transfer of the filter plate 8 to the plate holder 14 or insertion in plate receptacle 15 can be made using the travelling motion of the gas chamber 6. After retraction of the gas chamber 6 into a position above the core box 2, the plate holder is pivoted, so that through a tilting motion the soiled filter plate 8 from its horizontal position ends up in a diagonally downward, easy-to-access tilted position, so that access to the filter plate and its replacement with a cleaned or new filter plate 8 is facilitated. Moreover, through this tilting motion a filter plate 8 held in reserve ends up in the position in one of the other (17) three plate receptacles 15, 16, and 17 in reserve, in which the soiled filter plate 8 was previously located, so that this plate can be immediately accepted again by the core shooter.

To prevent the filter plate 8 inserted in a plate receptacle 15, 16 or 17 from falling out of the plate receptacle 15, 16 or 17 due to a tilting motion around a horizontally-oriented axis 18 or due to the arising steep tilting position, a latch 19, 20, or 21 is respectively provided at the inner end of each fork-shaped plate receptacle 15, 16 or 17. To carry out the tilting motion, a suitable rotary drive (not depicted) is connected to the transmission shaft 23 of the tilting plate holder 14.

Figure 4:
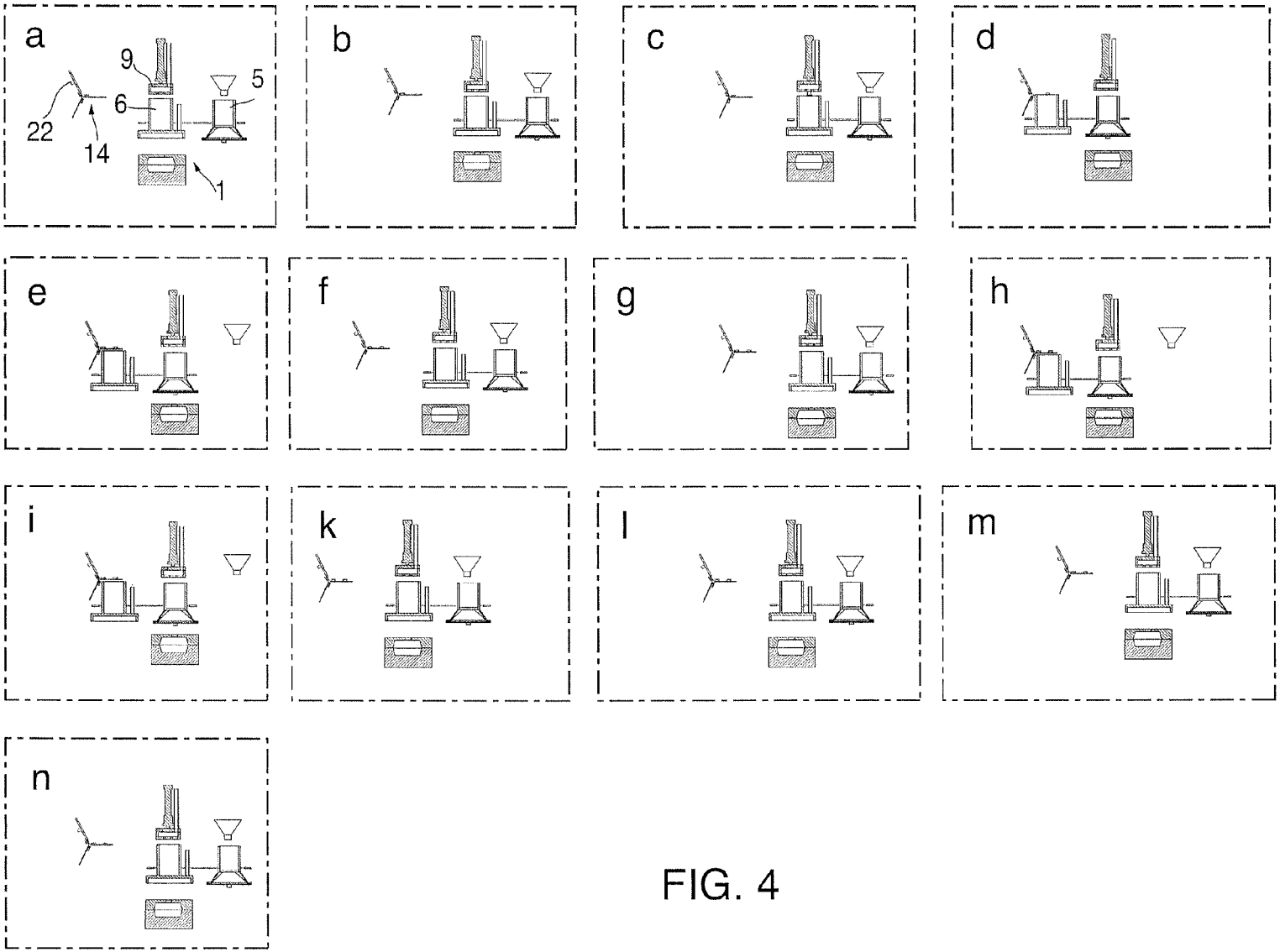

The sequence of the motion phases to be run through for the replacement of filter plate 8 is illustrated in FIG. 4 by depicting the successive positions, in this case "a" to "n". Starting from the position "a", the seal cover 9 sinks after position "b" and releases the lock 22 provided at the edge of the filter plate 8. In position "c" the seal cover 9 was raised from the filter plate 8, so that it rests loosely on the gas chamber 6. According to position "d", the gas chamber 6 with overlying filter plate 8 is moved to the left to the plate holder 14, so that the filter plate 8 engages with the plate receptacle 15 and locks in place with the latch 19. According to position "e", the gas chamber 6 has sunk, so that there is no contact with the filter plate 8. Consequently, the gas chamber 6 can return to the position according to "f", above the core box 2. This enables a tilting motion of the plate holder 14 in such a way that the soiled filter plate ends up in a downward, easy-to-access tilting position at 120°, as depicted in the position "g". At the same time, the cleaned filter plate 8 held in reserve in the plate receptacle 17 tilts into the vacant horizontal delivery position, into which the gas chamber 6 can retract under the filter plate 8, so that the position "h" is attained. According to position "i", the gas chamber 6 retracted under the new or cleaned filter plate 8 is raised, so that the filter plate 8 rests on it loosely.

Subsequently, the gas chamber 6 retracts with the overlying filter plate to position "k". According to position "l", subsequently the seal cover 9 is lowered onto the new filter plate 8 and the lock 22 is engaged between them. In position "m", the seal cover 9 along with the locked new filter plate 8 is raised again to the starting position for a new production cycle. In addition, in this position "m", the downward-tilted, soiled filter plate 8 is removed from the plate receptacle 15 and a new cleaned filter plate 8 is inserted in it. In position "n", the plate holder 14 is tilted further by 120° around its horizontal axis 18, so that the cleaned filter plate 8 ends up in the ready position corresponding to position "a".

It is evident that the motions of the described shooter components automatically controlled by suitable electrically, pneumatically or hydraulically operated drive elements can be carried out relatively fast.

The invention claimed is:

1. A core shooter apparatus comprising:

(a) a core box, (b) a core shooting chamber, (c) a gas chamber having a top on which a filter plate can rest, wherein the core shooting chamber and the gas chamber are movable transversely along a path between a first position with the gas chamber disposed above the core box and the core shooting chamber spaced laterally from the core box, and a second position with the gas chamber spaced laterally from the core box and the core shooting chamber disposed above the core box;

(d) a seal cover, the seal cover being movable between (i) a sealed position wherein the seal cover contacts either a top of the gas chamber with the gas chamber and core shooting chamber in the first position or a top of the core shooting chamber with the gas chamber and core shooting chamber in the second position, and (ii) an open position wherein the seal cover is spaced from either the top of the gas chamber with the gas chamber and the core shooting chamber in the first position or the top of the core shooting chamber with the gas chamber and the core shooting chamber in the second position; the seal cover comprising a lower end to which a filter plate can be attached and detached such that a filter plate detached from the lower end of the seal cover with the gas chamber in the first position can rest atop the gas chamber; and (e) a tilting holder comprising a plurality of filter plate receptacles, including a first filter plate receptacle and a second filter plate receptacle, the tilting holder being disposed along the path to which the gas chamber is movable and being pivotable about a pivot axis such that (i) the first filter plate receptacle can be pivoted to a position in the path wherein, when a filter plate rests atop the gas chamber and the gas chamber is moved transversely from the first position to the second position, the transverse motion of the gas chamber can cause the filter plate resting atop the gas chamber to engage with the first filter plate receptacle and to be transferred to the tilting holder; and (ii) the second filter plate receptacle can be pivoted to the position in the path wherein, when the second filter plate receptacle carries a clean filter plate and the gas chamber moves to the second position and presses against the second filter plate receptacle, the clean filter plate is released from the second filter plate receptacle to a position resting atop the gas chamber.

2. The core shooter apparatus according to claim 1, further comprising means for pressing the seal cover from the open position to the sealed position, a tube for compressed air leading into the seal cover, and a transfer carriage for moving the gas chamber and the core shooting chamber in the transverse direction.

3. The core shooter apparatus according to claim 1, wherein the tilting holder comprises three filter plate receptacles each of which is spaced at an angle of 120 degrees from an adjacent filter plate receptacle.

4. The core shooter apparatus according to claim 1, wherein each of the plurality of filter plate receptacles comprises two legs that are spaced from each other.

5. The core shooter apparatus according to claim 1, wherein each of the plurality of filter plate receptacles comprises a latch for locking a filter plate to the tilting holder.

6. A method for replacing a soiled filter plate in a core shooter with a clean filter plate, the method comprising:

(a) providing the core shooter apparatus of claim 1 with the soiled filter plate attached to the lower end of the seal cover and with the second filter plate receptacle carrying the clean filter plate and being positioned in the path;

(b) detaching the soiled filter plate from the lower end of the seal cover with the gas chamber in the first position so as to cause the soiled filter plate to rest atop the gas chamber;

(c) moving the gas chamber with soiled filter plate transversely to the second position so that the transverse motion of the gas chamber causes the soiled filter plate resting atop the gas chamber to engage with the first filter plate receptacle in the path and to be transferred to the tilting holder;

(d) subsequently retracting the gas chamber without the soiled filter plate from the second position and tilting the tilt holder so that the second filter plate receptacle carrying the clean plate is pivoted to the position in the path;

(e) moving the gas chamber to the second position to cause the top of the gas chamber to press against the second filter plate receptacle in the path and to release the clean plate so that it rests atop the gas chamber; and (f) moving the gas chamber with clean filter plate resting atop to the first position and attaching the clean filter plate to the lower end of the seal cover.

7. A method for replacing a soiled filter plate in a core shooter with a clean filter plate, the method comprising:

(a) providing the core shooter apparatus of claim 2 with the soiled filter plate attached to the lower end of the seal cover and with the second filter plate receptacle carrying the clean filter plate and being positioned in the path;

(b) detaching the soiled filter plate from the lower end of the seal cover with the gas chamber in the first position so as to cause the soiled filter plate to rest atop the gas chamber;

(c) moving the gas chamber with soiled filter plate transversely to the second position so that the transverse motion of the gas chamber causes the soiled filter plate resting atop the gas chamber to engage with the first filter plate receptacle in the path and to be transferred to the tilting holder;

(d) subsequently retracting the gas chamber without the soiled filter plate from the second position and tilting the tilt holder so that the second filter plate receptacle carrying the clean plate is pivoted to the position in the path;

(e) moving the gas chamber to the second position to cause the top of the gas chamber to press against the second filter plate receptacle in the path and to release the clean plate so that it rests atop the gas chamber; and (f) moving the gas chamber with clean filter plate resting atop to the first position and attaching the clean filter plate to the lower end of the seal cover.

8. A method for replacing a soiled filter plate in a core shooter with a clean filter plate, the method comprising:

(a) providing the core shooter apparatus of claim 3 with the soiled filter plate attached to the lower end of the seal cover and with the second filter plate receptacle carrying the clean filter plate and being positioned in the path;

(b) detaching the soiled filter plate from the lower end of the seal cover with the gas chamber in the first position so as to cause the soiled filter plate to rest atop the gas chamber;

(c) moving the gas chamber with soiled filter plate transversely to the second position so that the transverse motion of the gas chamber causes the soiled filter plate resting atop the gas chamber to engage with the first filter plate receptacle in the path and to be transferred to the tilting holder;

(d) subsequently retracting the gas chamber without the soiled filter plate from the second position and tilting the tilt holder so that the second filter plate receptacle carrying the clean plate is pivoted to the position in the path;

(e) moving the gas chamber to the second position to cause the top of the gas chamber to press against the second filter plate receptacle in the path and to release the clean plate so that it rests atop the gas chamber; and (f) moving the gas chamber with clean filter plate resting atop to the first position and attaching the clean filter plate to the lower end of the seal cover.

* * * * *